US006046436A

United States Patent [19]

Hunts

[11] Patent Number: 6,046,436

[45] Date of Patent: Apr. 4, 2000

[54] TOWEL WARMER

[76] Inventor: Barney Hunts, 145 Morris Ave., Mountain Lakes, N.J. 07046

[21] Appl. No.: 09/201,004

[22] Filed: Nov. 30, 1998

[51] Int. Cl.[7] ..... A21B 1/00

[52] U.S. Cl. ..... 219/400; 219/385; 219/386; 34/202

[58] Field of Search ..... 219/385, 386, 219/400; 34/202, 225, 104, 233, 239, 106; 126/21 A, 21 R

[56] References Cited

U.S. PATENT DOCUMENTS

| | | | |
|---|---|---|---|
| 3,839,622 | 10/1974 | Mastin | 219/400 |
| 4,644,136 | 2/1987 | Watchman | 219/400 |
| 4,918,290 | 4/1990 | DeMars | 219/400 |
| 5,842,287 | 12/1998 | Murphy | 34/202 |

*Primary Examiner*—Teresa Walberg
*Assistant Examiner*—Shawntina Fuqua
*Attorney, Agent, or Firm*—Alfred C. Hill

[57] ABSTRACT

A hot air towel warmer comprising a substantially airtight enclosure having an access door to enable placing a towel to be warmed in the enclosure and to enable removing the warmed towel therefrom; a shelf disposed within the enclosure having perforations therethrough to support the towel; a blower disposed within the enclosure adjacent to the shelf to create a stream of air and to continuously circulate the stream of air within the enclosure for passage through the perforations of the shelf and the towel; a resistance coil heater disposed within the enclosure adjacent the blower to heat the stream of air; and an electrical control circuit disposed within the enclosure associated with the stream of air, the blower and the heater to automatically maintain the stream of air at a temperature within a predetermined temperature range for a given period of time, or until the access door is opened, whichever occurs first.

20 Claims, 2 Drawing Sheets

TOWEL WARMER

BACKGROUND OF THE INVENTION

The present invention relates to towel warmers and more particularly to an improved hot air towel warmer.

The feel of a warm towel against the skin immediately after a shower or a bath is a delight that is only rarely enjoyed. If enjoyed in one's home, it is only because one has managed to complete a shower shortly after having run a load of towels through the washer and dryer.

In a bath or shower room area it is desirable to provide a rapid, convenient means for the uniform heating of articles, such as clothing or towels and the like as a preliminary to use. For example, in taking a bath or shower, a heating device or unit should be capable of heating or warming uniformly through several layers of towel over a period of a few minutes. In practice, this is difficult to achieve simply because cotton, the most common material used in towels, is such an excellent insulator. The thermal conductivity of cotton is one half that of asbestos, one tenth of window glass. As a result, the most efficient method of heating a towel is total immersion of each individual cotton fiber in a heated medium, hot air in the case of the present invention.

In the case of towel warming, problems arise when the towel is draped over a rod in that the mid section of the towel that is supported by the rod is compressed, rendering it difficult to flow warm air through it. In addition, due to the thickness and materials used in construction of towels, heat is not easily conducted through the towel.

Prior art warmers have hung a single section of a towel in front of a blower so that warm air is directed against one side of the towel. Such warmers generally rely on relatively slow heat conduction from one side of the towel to the other to thoroughly warm the towel. Other warmers have placed a heating element within a perforated support mounted in a housing. However, in such warmers, no provision has been made for forcing air to flow over the towel from within the towel support or around the support within the housing. As a result, the warming is relatively slow even though heat is transferred by convection, conduction and radiation.

Other warmers have suspended towels on hollow rods that are supplied with warm air. The rods have had holes therein to permit air to flow down between pendent sections of the towel that is draped over the rod. In some cases, such rods have been provided with nozzles to increase the flow downwardly between the pendent sections of the towel. Uniform heating of the towel still takes a relatively long time because there is no controlled airflow over both sides of the towel. Similarly, where holes are provided around the circumference of such rods, the towel is only subject to warm airflow from the inside which requires a longer period of warming.

Other towel-warming devices have been in the form of racks having rods for hanging a draped towel under a hood. A blower mounted in the hood above the towel blows air downwardly over the outside of the towel. With this relative positioning of the rods and the blower, the hanging towel prevents air from flowing against the inside surface of the towel such that increased time is required to warm the towel.

In other variations of units for warming a towel, a curtain is hung from a support to surround a towel that is hung freely from a bar of the support, a blower-heater below the towel directs warm air upwardly within the curtain across the freely hung towel. Because the towel hangs freely from the bar, no provision is made to keep pendanted sections of the towel apart nor to assure that air flows over both sides of or through the towel.

Despite prior efforts to warm towels, prior warming devices have operated relatively slowly, because air has been directed only along one side. Further, prior art warming devices have not effectively directed warm air simultaneously onto the inner and outer surfaces of draped towels in such manner as to force warm air through the mid section that is draped over a support. In addition, prior art warmers that have been provided with doors to permit access to the inside of a chamber have not been provided with racks supported by the door, such that when the door is open the rack has not been presented for easy loading and unloading of the towel.

SUMMARY OF THE INVENTION

An object of the present invention is to provide an improved hot air towel warmer that is capable of completely warming in a relatively short period of time a towel placed in the enclosed substantially airtight enclosure of the present invention.

Another object of the present invention is to provide a hot air towel warmer that is completely enclosed and recirculates the hot air so that the towel can be warmed quickly regardless of whether the towel is neatly folded or in a crumpled condition when inserted into the substantially airtight enclosure.

A feature of the present invention is the provision of a hot air towel warmer comprising a substantially airtight enclosure having a sealable access means to enable placing a towel to be warmed in the substantially airtight enclosure and to enable removing a warmed towel therefrom; first means disposed within the substantially airtight enclosure having air passages therethrough to support the towel; second means disposed within the substantially airtight enclosure adjacent the first means to create a stream of air and to continuously circulate the stream of air within the substantially airtight enclosure for passage through the first means and the towel; third means disposed within the substantially airtight enclosure adjacent the second means to heat the stream of air; and fourth means disposed within the substantially airtight enclosure associated with the stream of air, the third means and the second means to automatically maintain the stream of air at a temperature within a predetermined temperature range for a given period of time.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
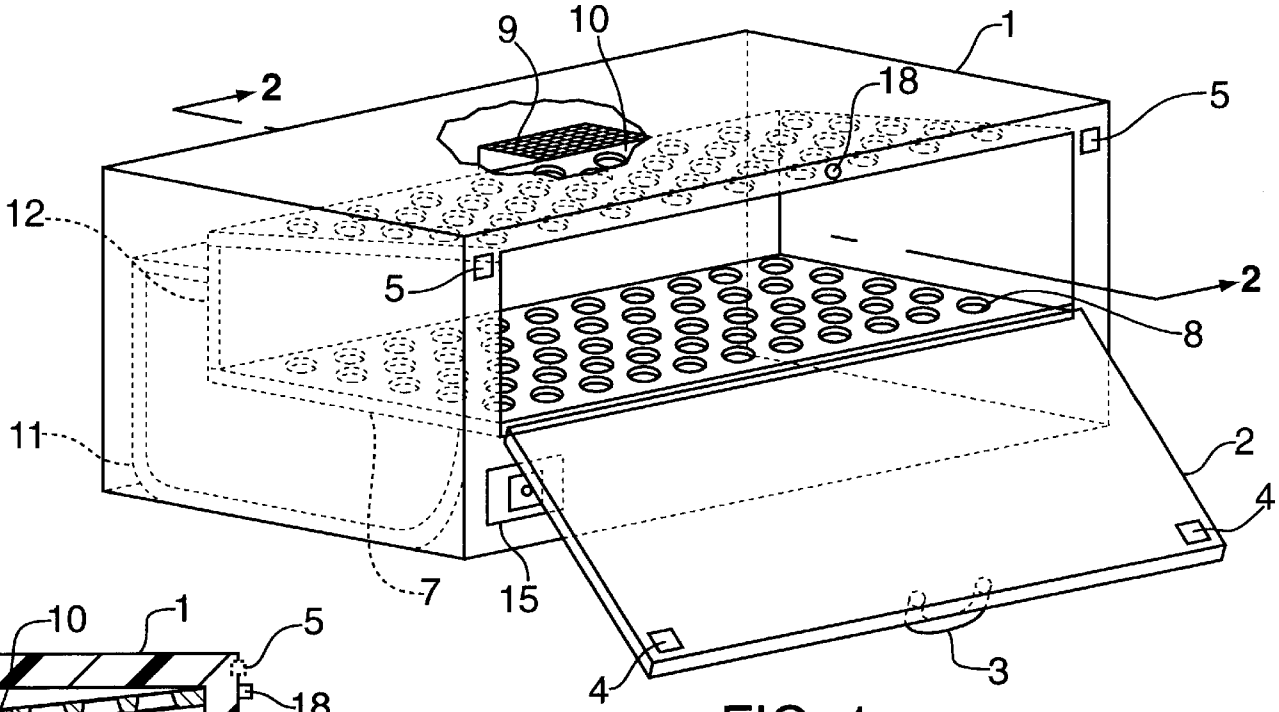
FIG. 1 is a perspective view of the hot air towel warmer in accordance with the principles of the present invention.
Figure 2:
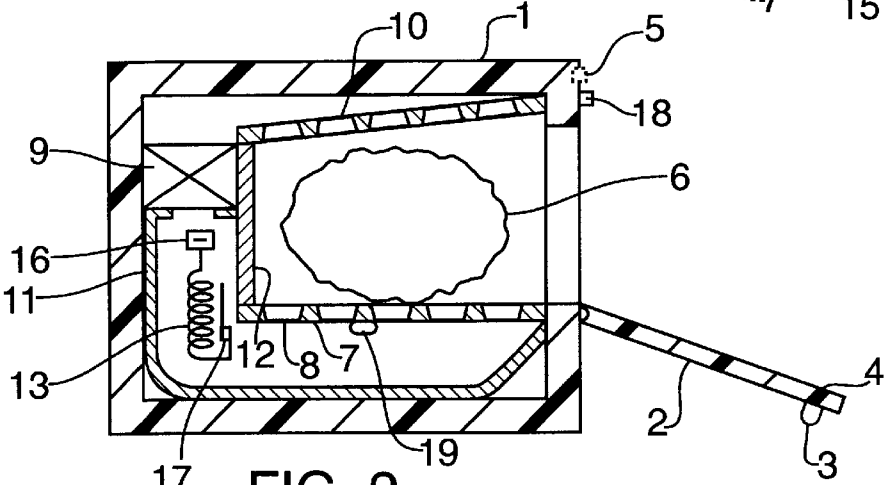
FIG. 2 is a cross-sectional view of the hot air towel warmer taken along the line 2—2 of FIG. 1.

Referring to FIGS. 1 and 2, the hot air towel warmer in accordance with the principles of the present invention includes a substantially airtight enclosure 1 having a sealable access means in the form of door 2 which is moveable into a closed position by handle 3 and held in a closed position by the magnetic or similar catches 4 and 5. The door 2 enables placing a towel 6 to be warmed in the enclosure 1 and to enable removing the warmed towel 6 from the enclosure 1. As illustrated in FIG. 2, the towel 6 is in a crumpled condition, but it could just as well be in a neatly folded condition, since regardless of the condition of the towel 6, the towel 6 is completely warmed throughout its bulk by means of total immersion in the temperature controlled forced hot air being recirculated within enclosure 1.

A first means in the form of shelf 7 having air passages therethrough in the form of perforations 8 is disposed within the airtight enclosure 1 to support the towel 6.

A second means in the form of blower 9 adjacent the rear of enclosure 1 creates a stream of air and continuously circulates the stream of air within the enclosure 1 for passage through the shelf 7 and the towel 6 being returned to blower 9 through the perforated baffle 10. Baffles 11 and 12 are provided to insure that the airstream is directed through the towel 6, the shelf 7 and the baffle 10.

The perforated baffle 10 is provided to ensure that the towel 6 is not sucked into the return of the blower 9 and to maintain the towel 6 within the space defined by the shelf 7 and the perforated baffle 10.

A third means in the form of a resistance coil heater 13 is disposed in the enclosure 1 adjacent the blower 9 to heat the air stream and hence the towel 6.

Figure 3:
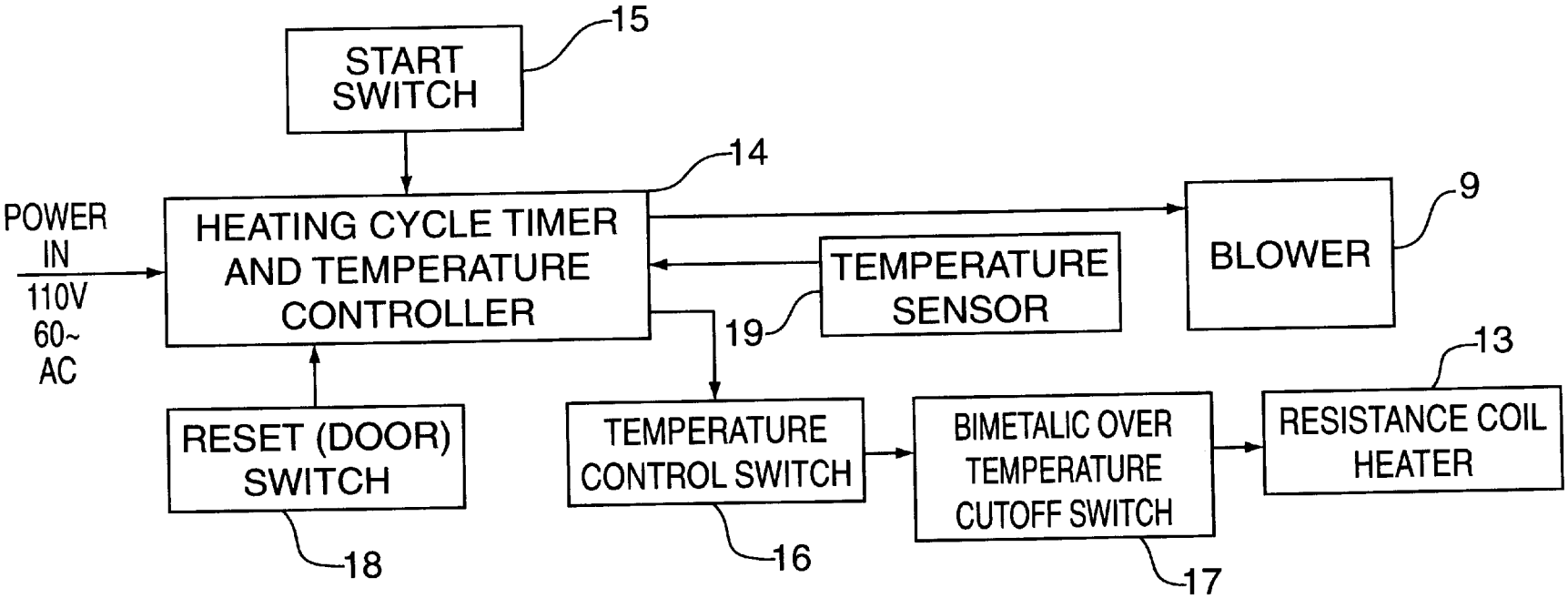
FIG. 3 is a block diagram of the electrical control system of the hot air towel warmer in accordance with the principles of the present invention.

The operation of the hot air towel warmer, in accordance with the principles of the present invention, is controlled by an electrical circuit, shown in block diagram form in FIG. 3, which constitutes the fourth means of the device to automatically maintain the stream of air at a temperature within a predetermined temperature range for a given period of time.

Referring to FIG. 3, the main control to establish the predetermined time and temperature range is provided by the heating cycle timer and temperature controller 14 which includes therein known electrical circuitry to provide a predetermined period of time for the heating cycle and the predetermined temperature range for the stream of air within enclosure 1. Controller 14 couples the power for operation of the blower 9 and the resistance coil heater 13 for a predetermined period of time established by any known timer circuit and a electrical circuit that establishes the range of temperature within which it is desired to maintain the stream of air to accomplish the heating of the towel 6. The heating cycle is started by the start switch 15 which may be placed in any convenient position on the enclosure 1, one of which is shown in FIG. 1. The controller 14 couples the power to blower 9 throughout the predetermined period of time with the power to heater 13 being interrupted by the temperature control switch 16 and/or the bimetallic over temperature cutoff switch 17. A temperature sensor 19 is located in the path of the stream of air where it first encounters the towel such that it measures the hotest temperature applied to the towel. By this means, a temperature high enough to achieve rapid thermal transfer to the towel can be maintained without any danger of scorching the towel as illustrated at 19 in FIG. 2. The cutoff switch 17 is illustrated in FIG. 2 at 17 and will cut the power to the heater 13 if the blower fan ceases to function for any reason, thus preventing overheating of the heater coil 13 which is dependent on the forced air flow for its cooling. The operating cycle will be interrupted and reset by the contact switch 18 when the door 2 is opened. When the door is opened switch 18 resets the controller 14 which is then ready for another cycle of operation to warm another towel, or the same towel when start switch 15 is operated.

The control arrangement as shown in FIG. 3 is such that the controller 14 will always supply power to blower 9 during the predetermined period of time, while the power to the resistance coil heater 13 will be interrupted by the temperature control switch 16 when the temperature of the air stream reaches its maximum desired level, and power will then be restored when the air temperature drops approximately 10° F. to its lower desired level, thus establishing the predetermined temperature range. The cutoff switch 17 interrupts the power to heater 13 if the air stream is interrupted such that the heating coil 13 overheats.

The given time period provided in the controller 14 is set to be longer than the time consumed by a normal shower or bath so that the warmed towel will be available to the occupant of the shower or bath when the shower or bath is completed, but the unit will shut off automatically should the individual fail to open the access door for any reason.

Temperature sensor 19 and control switch 16 can be provided by a bimetallic switch. This would be the simplest embodiment of sensor 19 and switch 16, would be the least expensive and would combine temperature sensing and control switch in a single unit. Any disadvantage might be the ability of the bimetallic switch to maintain a 10° F. deadband from 170° F. to 180° F. and to operate "hot" for many cycles of use over its lifetime. Another embodiment of sensor 19 and control switch 16 could be provided by a thermistor, level detecting amplifier and Triac solid state temperature sensor and switch. This arrangement has essentially an infinite "hot" switch lifetime and solid state reliability at a higher cost than the bimetallic switch embodiment.

While I have described above the principles of my invention in connection with specific apparatus, it is to be clearly understood that this description is made only by way of example and not as a limitation to the scope of my invention as set forth in the objects thereof and in the accompanying claims.

I claim:

1. A hot air towel warmer comprising:

a substantially air tight enclosure having a sealable access means to enable placing a towel to be warmed in said substantially air tight enclosure and to enable removing a warmed towel therefrom;

first means disposed within said substantially air tight enclosure having air passages therethrough to support said towel;

second means disposed within said substantially air tight enclosure adjacent said first means to create a stream of air and to continuously circulate said stream of air within said substantially air tight enclosure for passage through said first means and said towel;

third means disposed within said substantially air tight enclosure adjacent said second means to heat said stream of air; and fourth means disposed within said substantially air tight enclosure associated with said stream of air, said second means and said third means to automatically maintain said stream of air at a temperature within a predetermined temperature range for a given period of time.

2. A towel warmer according to claim 1, wherein said sealable access means includes a door disposed in a front surface of said substantially air tight enclosure.

3. A towel warmer according to claim 2, wherein said first means includes a shelf having perforations therethrough disposed the width of said substantially air tight enclosure intermediate a top and a bottom of said substantially air tight enclosure adjacent said door.

4. A towel warmer according to claim 3, wherein said second means includes an air blower disposed between a back wall of said substantially air tight enclosure and said shelf to create said stream of air and to continuously circulate said stream of air.

5. A towel warmer according to claim 4, wherein said third means includes a resistance coil heater to heat said stream of air.

6. A towel warmer according to claim 5, wherein said fourth means includes a heating cycle timer and temperature controller having an input coupled to a power source, a first power output coupled to said air blower, a second power output coupled to said resistance coil heater, a first switch to enable starting said given period and a second switch activated by said door to reset said given period of time when said door is opened and to enable starting said period of time when said door is closed and said first switch is activated, a temperature sensor and control switch disposed mechanically adjacent said shelf in said stream of air to enable disconnecting said resistance coil heater and yet keep said air blower operating to prevent scorching said towel, and a bimetallic over temperature cutoff switch connected to said resistance coil heater and disposed electrically between said second power outlet and said temperature sensor and control switch.

7. A towel warmer according to claim 1, wherein said first means includes a shelf having perforations therethrough disposed the width of said substantially air tight enclosure intermediate a top and a bottom of said substantially air tight enclosure adjacent said sealable access means.

8. A towel warmer according to claim 7, wherein said second means includes an air blower disposed between a back wall of said substantially air tight enclosure and said shelf to create said stream of air and to continuously circulate said stream of air.

9. A towel warmer according to claim 8, wherein said third means includes a resistance coil heater to heat said stream of air.

10. A towel warmer according to claim 9, wherein said fourth means includes a heating cycle timer and temperature controller having an input coupled to a power source, a first power output coupled to said air blower, a second power output coupled to said resistance coil heater, a first switch to enable starting said given period of time and a second switch activated by said sealable access means to reset said given period of time when said sealable access means is opened and to enable starting said period of time when said sealable access mean is closed and said first switch is activated, and a temperature sensing switch disposed mechanically adjacent said shelf in said stream of air to enable disconnecting said resistance coil heater and yet keep said air blower operating to prevent scorching said towel and disposed electrically between said second power output and a bimetallic over temperature cutoff switch connected to said resistance coil heater to enable disconnecting said resistance coil heater in the absence of adequate cooling flow of said stream of air.

11. A towel warmer according to claim 1, wherein said second means includes an air blower disposed between a back wall of said substantially air tight enclosure and said shelf to create said stream of air and to continuously circulate said stream of air.

12. A towel warmer according to claim 11, wherein said third means includes a resistance coil heater to heat said stream of air.

13. A towel according warmer to claim 12, wherein said fourth means includes a heating cycle timer and temperature controller having an input coupled to a power source, a first power output coupled to said air blower, a second power output coupled to said resistance coil heater, a first switch to enable starting said given period of time and a second switch activated by said sealable access means to reset said given period of time when said sealable access means is opened and to enable starting said period of time when said sealable access means is closed and said first switch is activated, and a temperature sensing switch disposed mechanically adjacent said first means in said stream of air to enable disconnecting said resistance coil heater and yet keep said air blower operating to prevent scorching said towel and disposed electrically between said second power output and a bimetallic over temperature cutoff switch connected to said resistance coil heater to enable disconnecting said resistance coil heater in the absence of adequate cooling flow of said stream of air.

14. A towel warmer according to claim 1, wherein said third means includes a resistance coil heater to heat said stream of air.

15. A towel warmer according to claim 14, wherein said fourth means includes a heating cycle timer and temperature controller having an input coupled to a power source, a first power output coupled to said second means, a second power output coupled to said resistance coil heater, a first switch to enable starting said given period of time and a second switch activated by said sealable access means to reset said given period of time when said sealable access means is opened and to enable starting said period of time when said sealable access means is closed and said first switch is activated, and a temperature sensing switch disposed mechanically adjacent said first means in said stream of air to enable disconnecting said resistance coil heater and yet keep said air blower operating to prevent scorching said towel and disposed electrically between said second power output and a bimetallic over temperature cutoff switch connected to said resistance coil heater to enable disconnecting said resistance coil heater in the absence of adequate cooling flow of said stream of air.

16. A towel warmer according to claim 1, wherein said fourth means includes a heating cycle timer and temperature controller having an input coupled to a power source, a first power output coupled to said second means, a second power output coupled to said third means, a first switch to enable starting said given period of time and a second switch activated by said sealable access means to reset said given period of time when said sealable access means is opened and to enable starting said period of time when said sealable access means is closed and said first switch is activated, and a temperature sensing switch disposed mechanically adjacent said first means in said stream of air to enable disconnecting said third means and yet keep said second means operating to prevent scorching said towel and disposed electrically between said second power output and a bimetallic over temperature cutoff switch connected to said third means to enable disconnecting said third means in absence of adequate cooling flow of said stream of air.

17. A towel warmer according to claim 1, wherein said first means includes a shelf having perforations therethrough disposed the width of said substantially air tight enclosure intermediate a top and a bottom of said substantially air tight enclosure adjacent said sealable access means; and said third means includes a resistance coil heater to heat said stream of air.

18. A towel warmer according to claim 17, wherein said fourth means includes a heating cycle timer and temperature controller having an input coupled to a power source, a first power output coupled to said second means, a second power output coupled to said resistance coil heater, a first switch to enable starting said given period of time and a second switch activated by said sealable access means to reset said given period of time when said sealable access means is opened and to enable starting said period of time when said sealable access means is closed and said first switch is activated, and a temperature sensing switch disposed mechanically adjacent said shelf and in said stream of air to enable disconnecting said resistance coil heater and yet keep said second means operating to prevent scorching said towel and disposed electrically between said second power output and a bimetallic over temperature cutoff switch connected to said resistance coil heater to enable disconnecting said resistance coil heater in the absence of adequate cooling flow of said stream of air.

19. A towel warmer according to claim 1, wherein said second means includes an air blower disposed between a back wall of said substantially air tight enclosure and said first means to create said stream of air and to continuously circulate said stream of air; and said fourth means includes a heating cycle timer and temperature controller having an input coupled to a power source, a first power output coupled to said air blower, a second power output coupled to said third means, a first switch to enable starting said given period of time and a second switch activated by said sealable access means to reset said given period of time when said sealable access means is opened and to enable starting said period of time when said sealable access means is closed and said first switch is activated, and a temperature sensing switch disposed mechanically adjacent said first means in said stream of air to enable disconnecting said third means and yet keep said air blower operating to prevent scorching said towel and disposed electrically between said second power output and a bimetallic over temperature cutoff switch connected to said third means to enable disconnecting said third means in the absence of adequate flow of said stream of air.

20. A towel warmer according to claim 1, wherein said first means includes a shelf having perforations therethrough disposed the width of said substantially airtight enclosure intermediate a top and a bottom of said substantially air tight enclosure adjacent said sealable access means; and said fourth means includes a heating cycle timer and temperature controller having an input coupled to a power source, a first power output coupled to said second means, a second power output coupled to said third means, a first switch to enable starting said given period of time and a second switch activated by said sealable access means to reset said given period of time when said sealable access means is opened and to enable starting said period of time when said sealable access means is closed and said first switch is activated, and a temperature sensing switch disposed mechanically adjacent said shelf in said stream of air to enable disconnecting said third means and yet keep said second means operating to prevent scorching said towel and disposed electrically between said second power output and a bimetallic over temperature cutoff switch connected to said third means to enable disconnecting said third means in the absence of adequate cooling flow of said stream of air.

* * * * *